United States Patent [19]

Micciche

[11] 4,267,695

[45] May 19, 1981

[54] BUOYANCY ENERGY ENGINE

[76] Inventor: Peter Micciche, 614 Drexel Ave., Drexel Hill, Pa. 19026

[21] Appl. No.: 79,570

[22] Filed: Sep. 27, 1979

[51] Int. Cl.[3] ..... F03C 1/00

[52] U.S. Cl. ..... 60/473; 60/495; 60/503

[58] Field of Search ..... 60/325, 369, 473, 495, 60/496, 503

[56] References Cited

U.S. PATENT DOCUMENTS

| | | | |
|---|---|---|---|
| 1,502,901 | 7/1924 | Bristow | 60/503 |
| 3,485,038 | 12/1969 | Martin | 60/503 |
| 4,083,186 | 4/1978 | Jackson | 60/503 X |
| 4,207,741 | 6/1980 | Rainey | 60/496 |

*Primary Examiner*—Robert G. Nilson

*Attorney, Agent, or Firm*—Weiser, Stapler & Spivak

[57] ABSTRACT

The engine comprises an elongated, vertical casing within which a buoyancy piston is vertically reciprocal between upper and lower positions. The buoyancy piston bottomly carries a bottom piston plate which is a sliding seal within the interior of the casing. A flapper check valve is positioned on the piston plate to alternately open or close the valve opening to thereby allow the liquid to pass through the plate to impinge buoyancy forces upon the underside of the piston. A circulating pump draws its suction below the piston plate and discharges to the top of the casing at a height elevated above the piston plate. Cyclical opening and closing of the flapper check valve causes corresponding reciprocal movement of the power piston within the casing to power an output shaft for reciprocal motion.

7 Claims, 5 Drawing Figures

BUOYANCY ENERGY ENGINE

BACKGROUND OF THE INVENTION

The present invention relates generally to engines capable of developing reciprocating motion, and more particularly, is directed to a buoyancy energy engine designed to reciprocate an output shaft by utilizing the buoyancy of fluid contained within a vertical hollow casing.

The buoyancy energy engine of the present invention utilizes the buoyancy effect of water to elevate a buoyancy piston within a vertical, hollow casing. By alternately exposing and shielding the bottom of the buoyancy piston to the buoyant effect of a liquid, the power piston can be made to reciprocate within the casing to simultaneously reciprocate an output power shaft.

SUMMARY OF THE INVENTION

The present invention relates generally to the field of reciprocating engines, and more particularly, is directed to a buoyancy energy engine comprising essentially a device that derives its power from the buoyancy effect of a fluid retained within a vertical column.

The engine of the present invention includes generally a hollow, cylindrical casing fabricated to a height considerably greater than its diameter. It is contemplated that the casing can be ten feet in height, twenty feet in height, one hundred feet in height or even of greater dimensions to thereby increase the work output of the power shaft.

A power piston, for example, a hollow, buoyant member is positioned within the casing for vertical reciprocation therewithin. The buoyancy piston bottomly carries a piston plate and is secured thereto whereby the piston and the piston plate vertically reciprocate in unison. The plate is spaced below the piston and includes a central opening for cyclical passage of liquid therethrough during the piston reciprocation process. The piston plate opening is equipped with a check valve of suitable design to alternately permit and prevent the passage of liquid through the plate opening.

The plate includes a peripheral, sliding seal to discourage the passage of liquid between the peripheral junction comprising the interior of the vertical casing and the periphery of the piston plate.

A circulating pump draws its suction from the bottom of the casing below the bottom of the piston plate and discharges liquid into the top of the casing above the top of the power piston. When liquid is drawn from beneath the piston plate with the check valve closed, the joined power piston and piston plate will be caused to descend relative to the vertical casing. As the bottom of the piston plate approaches the bottom of the casing, the check valve is opened to thereby cause liquid pumped by the circulating pump to pass through the opening to expose the bottom of the piston. The buoyancy effect upon the piston is against the bottom or floor of the casing to thereby cause the buoyancy piston to rise.

An output shaft is upwardly carried by the power piston in a fixed manner whereby the output shaft will rise and fall as the piston itself is caused to vertically reciprocate within the interior of the casing. The reciprocating motion of the output shaft can be transformed into rotary motion by utilizing known techniques to thereby power rotary equipment, for example an electrical generator or alternator.

It is therefore an object of the present invention to provide an improved buoyancy energy engine of the type set forth.

It is another object of the present invention to provide a novel buoyancy energy engine capable of utilizing the buoyancy effect of a liquid to reciprocate an output shaft for power producing purposes.

It is another object of the present invention to provide a novel buoyancy energy engine comprising an elongated, vertical, hollow casing within which a buoyancy piston is vertically reciprocal in response to the buoyancy effect of a controlled amount of a liquid.

It is another object of the present invention to provide a novel buoyancy energy engine including a hollow, vertical casing, a power piston vertically reciprocal within the casing and means to transmit the buoyancy effect of a fluid within the casing to a power output shaft for work producing purposes.

Other objects and a fuller understanding of the invention will be had by referring to the following description and claims of a preferred embodiment thereof, taken in conjunction with the accompanying drawings, wherein like reference characters refer to similar parts throughout the several views and in which:

DESCRIPTION OF THE PREFERRED EMBODIMENT OF THE INVENTION

Figure 1:
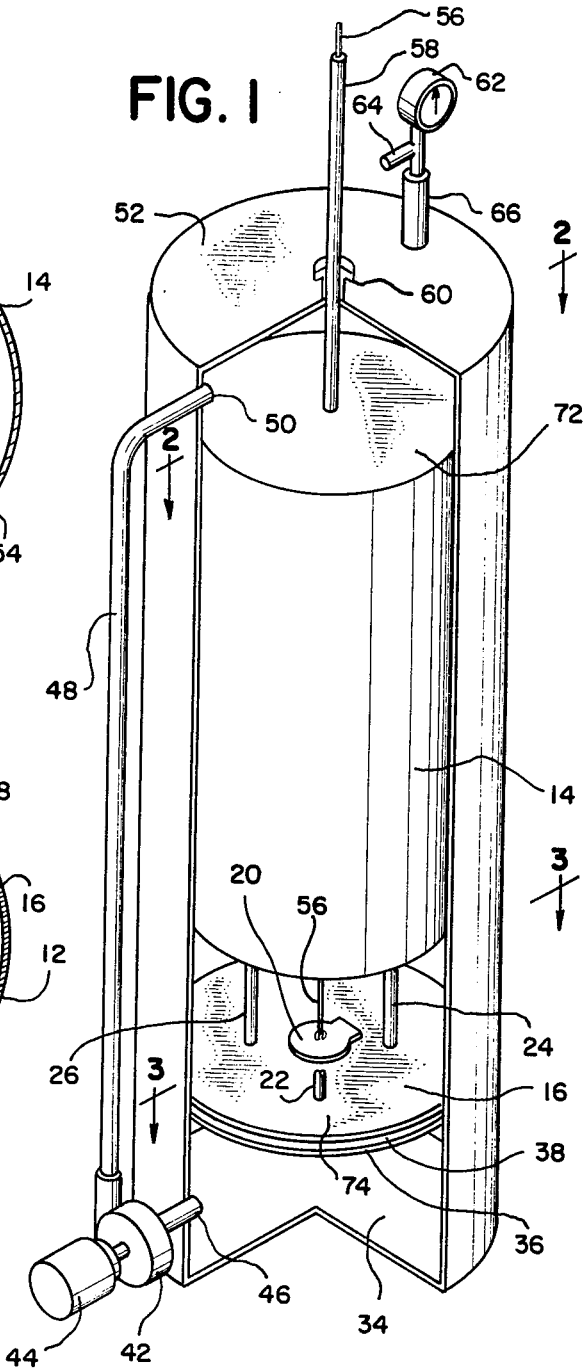
FIG. 1 is a perspective view of the buoyancy energy engine, partially broken away to expose interior construction details.
Figure 2:
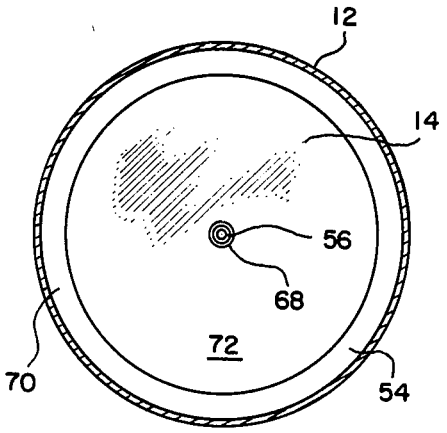
FIG. 2 is a cross sectional view taken along line 2—2 on FIG. 1, looking in the direction of the arrows.
Figure 3:
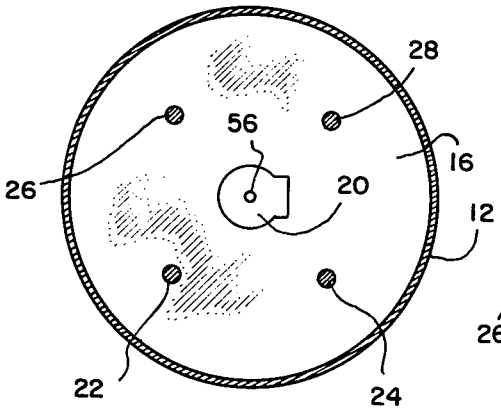
FIG. 3 is a cross sectional view taken along line 3—3 on FIG. 1, looking in the direction of the arrows.

Although specific terms are used in the following description for the sake of clarity, these terms are intended to refer only to the particular structure of the invention selected for illustration in the drawings, and are not intended to define or limit the scope of the invention.

Referring now to the drawings, there is shown in FIG. 1 a buoyancy energy engine generally indicated by the numeral 10 which comprises essentially a hollow, elongated, vertical casing 12 having a closed top 52 and a closed bottom 34. The casing is fabricated of liquid-tight construction suitable to retain a liquid (not shown) therewithin. In a preferred embodiment, the casing 12 is fabricated of suitable, sturdy material as necessary to withstand the pressures developed by the height of the liquid retained therewithin. Steel of iron pipe size thickness has been found suitable for many practical applications of the system.

Within the hollow interior 70 of the casing 12 is positioned a hollow, power piston 14 of suitable construction to be effected by the buoyancy of the liquid (not shown) when exposed to the buoyancy forces of the liquid. The power piston 14 is fabricated of lesser height than the height of the casing to provide top and bottom clearance whereby the power piston can vertically reciprocate within the interior 70 of the casing 12 in response to the buoyancy effects of the liquid.

Figure 4:
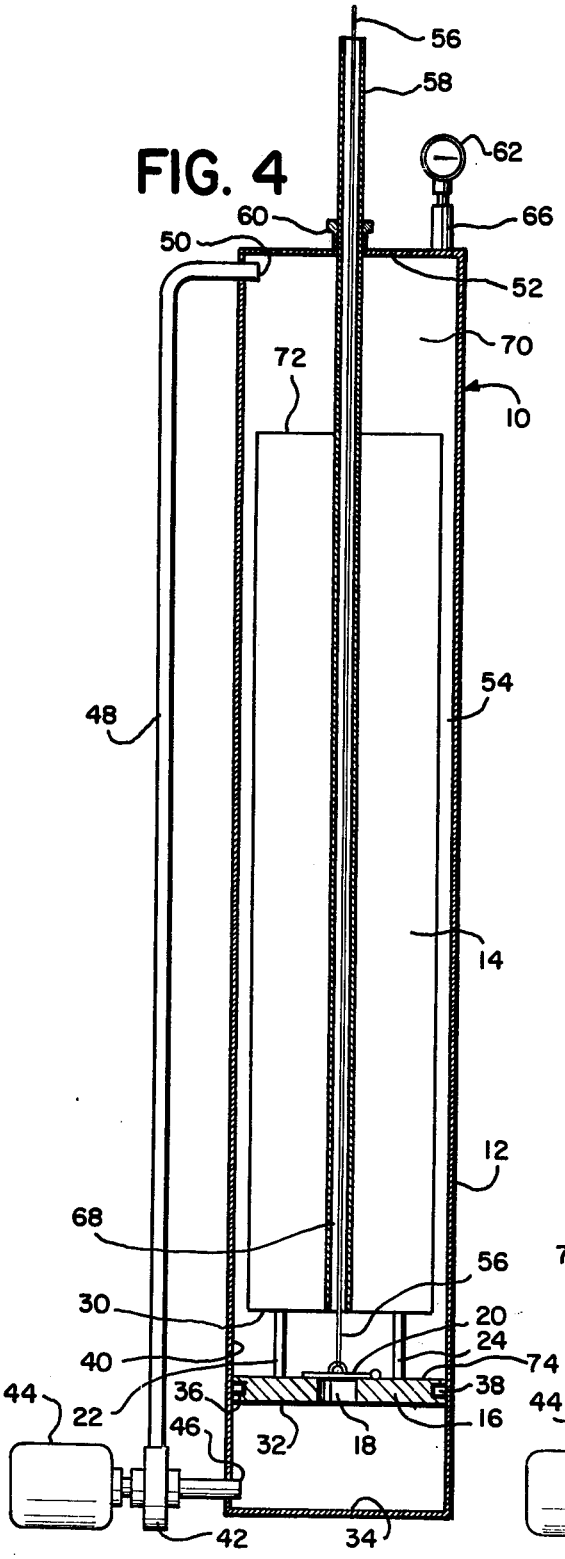
FIG. 4 is a vertical, sectional view showing the piston and piston plate in a lower position.
Figure 5:
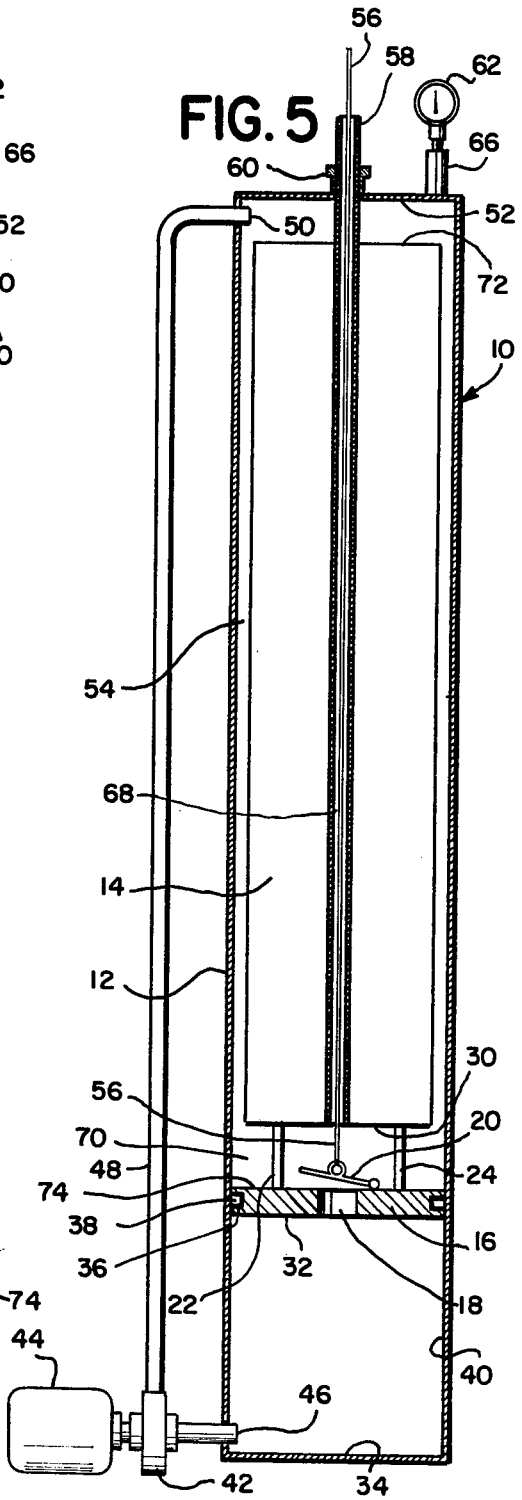
FIG. 5 is a view similar to FIG. 4 showing the piston and piston plate in an upper position.

As seen in FIGS. 1, 4 and 5, the power piston 14 bottomly, fixedly carries a piston plate 16 in spaced relationship therebelow. As illustrated, the power piston 14 is fabricated of smaller diameter than the sidewalls of the casing 12 to thereby provide a clearance space 54 therebetween. The piston plate 16 is fabricated of size only slightly smaller than the interior dimensions of the casing and is peripherally machined or otherwise formed to provide a peripheral retainer 36 within which a peripheral seal 38, for example an O-ring sealing member can be securely retained. It is of importance in this invention to allow the piston plate 16 to vertically reciprocate within the interior of the casing 12 in a sealed, sliding engagement. Such a sealed, sliding engagement is provided by the interaction of the peripheral seal 38 and the interior 40 of the casing sidewalls.

Still referring to FIGS. 1, 4 and 5, a pump 42 powered in conventional manner by a motor 44 draws its suction 46 from within the interior 70 of the casing 12 below the bottom 32 of the piston plate 16. The pump 42 functions to remove the liquid (not shown) from below the piston plate 16 and to pump it upwardly through the circulating line 48 to the pump discharge 50. The liquid is discharged into the interior 70 of the casing 12 above the top 72 of the power piston 14. The clearance space 54 provided between the power piston 14 and the interior 40 of the casing sidewalls allows the liquid to fill the entire interior space 70 above the top 74 of the piston plate 16.

For pressure monitoring purposes, the top 52 of the casing 12 may be provided with a gauge riser 66 upon which is mounted a pressure gauge 62 in known manner to gauge the pressures within the interior of the casing 12. If desired, a gauge vent 64 can also be provided in known manner.

An output shaft 58 which may be in the form of a hollow shaft as illustrated, affixes to the power piston 14 in a manner to simultaneously vertically reciprocate as the power piston 14 is reciprocated by the buoyancy effects of the liquid. The output shaft 58 extends through the top 52 of the casing 12 through a top opening provided for this purpose. The top opening may be rendered leakproof by providing a conventional packing gland 60 or other known construction to prevent the escape of liquid (not shown) as the output shaft 58 is reciprocated. In the embodiment illustrated, a check valve operator 56, which may be a flexible wire or other suitable cord, extends downwardly through the hollow interior of the shaft 58 to the flapper 20 of the check valve. Accordingly, upon pulling upwardly on the operator cord 56, the flapper 20 can be pulled upwardly relative to the top 74 of the piston plate 16 to alternately expose or close the valve opening 18.

In operation, with the casing 12 of the energy engine 10 filled with fluid (not shown), the operation can begin by energizing the motor 44 to function the pump 42. At the start of the cycle, the flapper check valve 20 is in its closed position as illustrated in FIG. 4 to thereby close the opening 18 through the piston plate 16. With the flapper check valve 20 so positioned, fluid is urged by the pump 42 from below the bottom 32 of the piston plate 16 upwardly through the circulating line 48, through the discharge 50 and into the interior 70 of the casing 12 above the top 72 of the power piston 14. This displacement of the fluid causes the power piston 14 to descend within the interior of the casing 12 due to both the weight of the liquid acting upon the top 74 of the plate 16 and the removal of the liquid (not shown) from below the bottom 32 of the plate 16. The power piston 14 will then descend to a lower position, as best seen in FIG. 4.

When the power piston 14 is thus urged to its lower position, the check valve operator 56 is upwardly pulled to pull the flapper 20 away from the opening 18 as best seen in FIG. 5. When the opening 18 is thereby exposed, the entire buoyancy effect upon the piston 14 is against the bottom or floor 34 of the casing 12, thereby causing the buoyancy piston 14 to rise within the casing 12 to its upper position as illustrated in FIG. 5. The motor 44 is deactivated as the buoyancy effect of the liquid causes the power piston 14 to rise within the casing 12. The upward movement of the piston 14 causes simultaneous, corresponding, upward movement of the output shaft 58 inasmuch as the shaft 58 is securely affixed to the piston 14. The packing gland 60 acts to prevent escape of liquid about the top 52 of the casing as the output shaft 58 is moved.

When the power piston 14 reaches its upper position as illustrated in FIG. 5, the operator 56 is functioned to close the flapper 20 over the opening 18 to prevent fluid passage therethrough. The pump motor 44 is activated to again circulate fluid from below the bottom 32 of the piston plate 16 to above the top 72 of the buoyancy piston 14. The affect of this pumping applies fluid pressure against the top 74 of the plate 16 to again push the plate 14 toward the casing bottom 34 as hereinbefore set forth. The movement of the plate 16 downwardly pulls the power piston 14 also downwardly due to the interconnecting supports 22, 24, 26, 28. When the piston plate 16 reaches its lowermost position of travel as illustrated in FIG. 4, the pump 42 is deactivated and the check valve 20 is again opened to repeat the cycle.

The power piston 14 rises within the interior 70 of the casing 12 from the position illustrated in FIG. 4 to the position illustrated in FIG. 5 when the flapper check valve 20 is opened due to the buoyant force acting between the bottom 34 of the casing and the power piston 14.

If desired, suitable limit controls can be provided in known manner to automatically function the motor 44 and the flapper check valve 20 to thereby automatically reciprocate the power piston 14 and the affixed output shaft 58 between the said lower and upper positions in an automatic manner.

Although the invention has been described with a certain degree of particularity, it is understood that the present disclosure has been made only by way of example and that numerous changes in the details of construction and the combination and arrangement of parts may be resorted to without departing from the spirit and scope of the invention.

What is claimed is:

1. In a buoyancy energy engine, the combination of a vertical casing defining an interior piston space, the casing having a top, a bottom and interconnecting sidewalls;

a buoyancy piston means reciprocal within the casing between an upper position and a lower position, the buoyancy piston means comprising a piston and being buoyant in a circulating liquid, the buoyancy piston means defining a clearance space for the circulating liquid between the piston and the casing sidewalls, top and bottom;

a sealing plate means affixed to the piston, the sealing plate means comprising a peripheral seal, the seal being adapted for sliding, sealing engagement with the casing sidewalls to prevent liquid leakage thereabout as the piston is reciprocated, the sealing plate means being provided with an opening to permit liquid passage therethrough and a valve means to alternately close and expose the opening to control the passage of the liquid;

a circulating pump means to circulate the liquid about the piston, the pump means drawing its suction from the casing below the sealing plate means and discharging into the casing above the sealing plate means; and a work output shaft affixed to the buoyancy piston means and adapted to reciprocate as the piston is reciprocated, the work output shaft being positioned partially within and partially without the casing.

2. The buoyancy energy engine of claim 1 and remote operator means to function the valve means.

3. The buoyancy energy engine of claim 2 wherein at least a portion of the work output shaft is hollow.

4. The buoyancy energy engine of claim 3 wherein the remote operator means enters the casing through the hollow work output shaft.

5. The buoyancy energy engine of claim 1 wherein the sealing plate means is affixed in spaced relation below the buoyancy piston means.

6. The buoyancy energy engine of claim 1 wherein the casing and the seal plate means are circular in cross sectional configuration and wherein the casing defines a longitudinal, vertical central axis.

7. The buoyancy energy engine of claim 6 wherein the opening is positioned in alignment with the casing central axis.

* * * * *